US005601190A

United States Patent [19]

Weber

[11] Patent Number: 5,601,190

[45] Date of Patent: Feb. 11, 1997

[54] NEWSPAPER POUCH

[76] Inventor: Thomas Weber, Brunnentalstrasse 100/1, D-78532 Tuttlingen, Germany

[21] Appl. No.: 421,228

[22] Filed: Apr. 13, 1995

[30] Foreign Application Priority Data

Nov. 9, 1994 [DE] Germany ..... 9417908 U

[51] Int. Cl.[6] ..... B65D 85/66

[52] U.S. Cl. ..... 206/389; 206/407; 206/409; 220/482

[58] Field of Search ..... 206/389, 391, 206/407, 408, 409; 220/482; 215/277, 278; 229/5.5; 280/47.19, 47.26

[56] References Cited

U.S. PATENT DOCUMENTS

| | | | |
|---|---|---|---|
| 423,712 | 3/1890 | Arnold | 206/407 X |
| 1,716,249 | 6/1929 | Taylor et al. | 206/407 |
| 1,753,928 | 4/1930 | Hulbert | 383/71 X |
| 1,846,748 | 2/1932 | Palmer | 383/71 |
| 2,044,422 | 6/1936 | Davidson | 229/5.5 |
| 2,687,895 | 8/1954 | Rutledge | 280/47.26 |
| 3,327,924 | 6/1967 | Brutting | 383/88 |
| 3,907,104 | 9/1975 | Taub | 206/45.23 |
| 4,629,153 | 12/1986 | Marcum | 220/482 X |
| 4,984,704 | 1/1991 | O'Malley | 220/23.4 |
| 5,131,538 | 7/1992 | Thibodeau | 206/389 |

FOREIGN PATENT DOCUMENTS 2223935 4/1990 United Kingdom .

*Primary Examiner*—David T. Fidei
*Attorney, Agent, or Firm*—Dominik & Stein

[57] ABSTRACT

The newspaper carrying pouch is provided with attachment means (4, 5) for securing on a carrying strap, newspaper wagon (12) or the like. For filling up of the newspaper carrying pouch (1) an opening (6) is provided. The newspaper carrying pouch (1) is constructed as a tubular shaped container for insertion of a roll pack (7), whereby the container is closed off on its first end with a first lid part (2) and on its other end, through which the roll pack (7) is introduced into the newspaper carrying pouch (1), with at least a partially closeable second lid part (3).

8 Claims, 2 Drawing Sheets

NEWSPAPER POUCH

Figure 1:
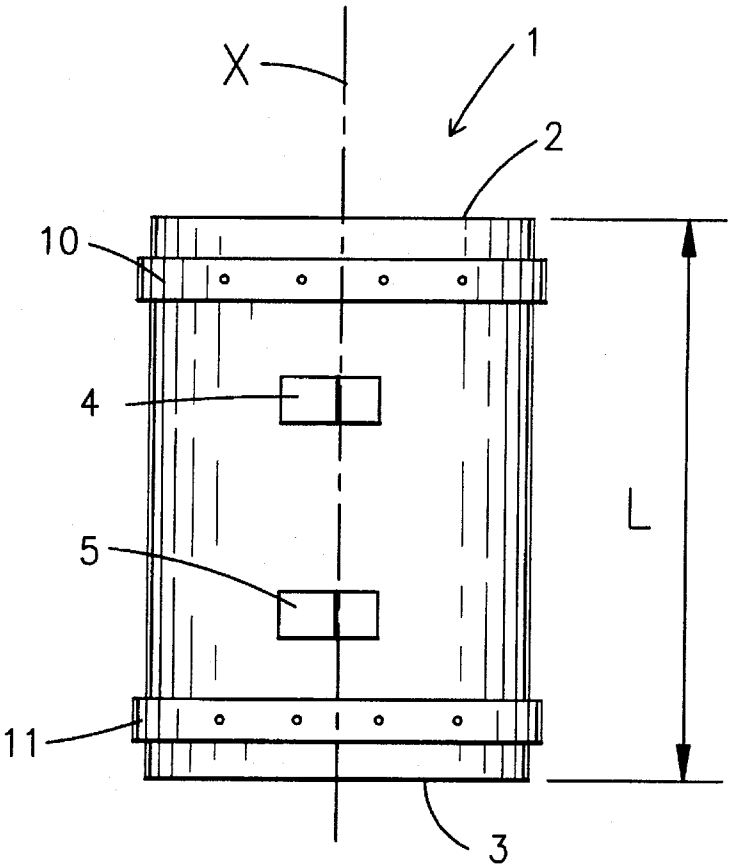

The invention concerns a newspaper pouch with attachment means for securing to a carrier, news wagon, or the like, and with an opening for inserting newspapers into the pouch.

Newspaper pouches have long been known and are regularly used in the newspaper industry. The newspaper pouches are conventionally transported by means of a hand wagon or by means of a carrier pouch. The known newspaper pouches traditionally have a cubic shape and are provided on their lower part with a base and on their upper side with a lockable lid component, which is foldable over an upwardly directed opening which is capable of being secured by means of a locking mechanism such as a buckle. Newspapers as conventionally packaged in parcels are carried in these known roughly cubic pouches.

Recently, packaging processes for newspapers, magazines, and the like, have been developed which no longer package the newspapers or magazines in the conventional parcel, but rather in roll packs. In accordance with this packaging system, the usual stacking of newspapers one above the other is repackaged into consumer-ready package rolls.

In comparison to the conventional newspaper packages, packaging systems involving roll packs exhibit significant advantages. It is substantially more economical due to the simplified assembly process. For example, the conventionally required turnstile stations of the packaging assembly lines can be dispensed with. The so-called "flaking off", that is, the continuous flow of newspapers out of the production line for the newspapers, remains continuous, whereby a smoother production flow is obtained. In each case, depending upon the desired number of newspapers to be assembled into a roll pack, the corresponding number of newspapers are wrapped around a spindle and subsequently wrapped with, for example, a preferably self-adhering stretch-cling film or packaging paper. Further, cover papers and even also accompanying packs can be enveloped at the same time. At the end point of the packaging system a distribution ready packaging roll is available, of which the cross-section depends upon the number and thickness of the individual newspapers or, as the case may be, newspaper periodicals, which are contained in the roll pack. In comparison, the height of the roll pack is, however, independent of the number of newspapers and is always the same.

Above and beyond this, these roll packs provide a flexible, individual manipulability of the rolls. They are constructed so as to be disassembled from the center outwards in a simple manner, without requiring the removal of the protective outer cover.

Roll pack-packaging systems are, for example, produced by the firm FERAG AG, Zurich, Switzerland. Although the use of the roll packs offers a large number of advantages, the handling of such roll packs in the hitherto conventional newspaper carrying pouches has hitherto been found to be an inconvenience in the industry by newspaper carriers. The roll packs must be transported in the above-mentioned conventional cubic newspaper pouches. Obviously, in this case the bottom side of the roll pack must rest upon the base of the newspaper pouch so that the roll pack can be disassembled from the center and distributed from the newspaper carrying pouch. It has, however, been observed in practice that the newspaper carriers take the newspapers and magazines from the roll packs and first convert these back into the conventional packet and only then do they put these packets in the known cubic newspaper carrying pouches.

The present invention has the object of providing a newspaper carrying pouch which is in particular suitable for the storage of roll packs.

This object is solved in accordance with the characteristics of claim 1.

Further embodiments of such a newspaper carrying pouch are set forth in the dependent claims.

The invention is concerned primarily with the design of a newspaper carrying pouch in the form of a tubular container for the carrying of roll packs. The tubular container is for this purpose closed off on a first end with a first lid part and which is provided on its second end with at least a partially lockable second lid part, preferably made of a flexible synthetic or natural cloth material, which is closeable by means of a draw string or elastic band. The roll pack can be introduced into the tubular container shaped newspaper carrying pouch through this second lid component.

The essential advantage of the newspaper carrying pouch according to the invention lies in the tubular shaped design of the newspaper carrying pouch so that the roll pack is enveloped by the newspaper carrying pouch in the manner of a jacket. The tubular shaped container is provided around its cylindrically shaped outer circumference part with attachment means or mounting supports for a carrying strap, so that the newspaper bag can be carried by the newspaper carrier by hanging the bag over the shoulder. The newspaper carrying pouch according to the present invention is carried in such a way that the two covers are positioned on the sides. An advantage of the newspaper carrying pouch is that it can be carried over either the left or the right shoulder, so that either the left or the right hand can reach into the second lid part in order to pull a newspaper or magazine out of the center of the roll pack.

The second lid part, which is a flexible synthetic or natural material or as the case may be may be made of a plastic or natural material sheet or of a nylon mesh is preferably closeable by means of a pull string, an elastic cord, or the like. As a result thereof it is insured that the roll pack is protected against moisture and wetness during distribution of the newspapers.

The roll shaped container and the first lid part are comprised preferably of a synthetic or plastic material and form a can-shape. The first lid part and the tubular shaped container are preferably formed as a single piece. The open side of such a can-like shape is closed off with the above previously discussed flexible second lid part.

For structural stabilization of the tubular shaped container this can be provided with ring shaped strengthening members, which are preferably disposed on the rim sides of the tubular shaped container and on the outer circumference.

The inventive newspaper carrying pouch is however not only suitable for the carrying with a carrier strap. The newspaper carrying pouch according to the invention can also be mounted on a newspaper wagon. For this the newspaper bag is provided with special mounting or attaching means. The mounting means may suitably be, for example, a belt or strap, which on the one hand is secured to the newspaper carrying pouch and on the other hand is fastened to the newspaper wagon.

Beyond this, a number of such newspaper carrying pouches, preferably stacked one above the other, can be secured to the newspaper wagon. As a result thereof it is accomplished that the newspaper distributor can carry or distribute a number of roll packs.

In a illustrative embodiment according to the invention the inventive newspaper carrying pouch can have an inner cross-section of approximately 29 centimeters and a length of approximately 41 centimeters. The newspaper carrying pouch can, however, easily be tailored to other measurements depending upon the roll packs to be distributed.

The invention will be described in the following in connection with the five figures. There are shown.

Figure 2:
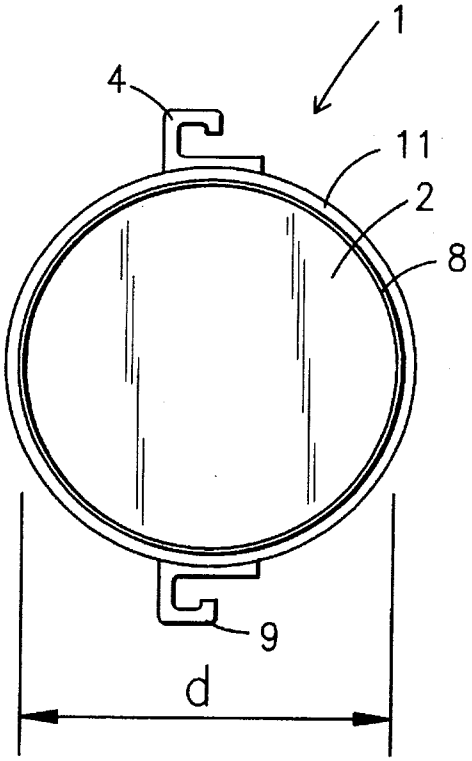
Figure 3:
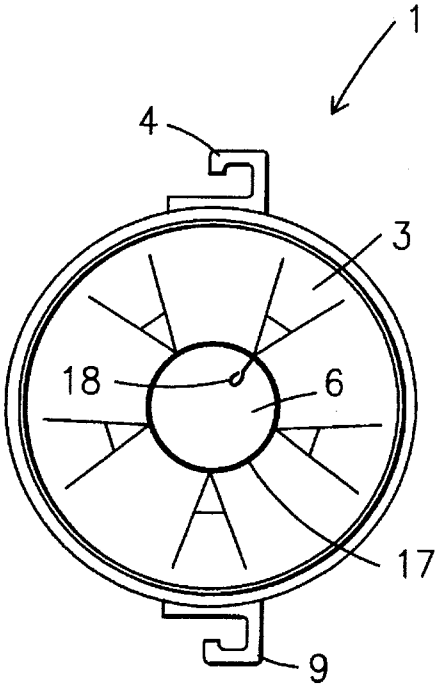
Figure 5:
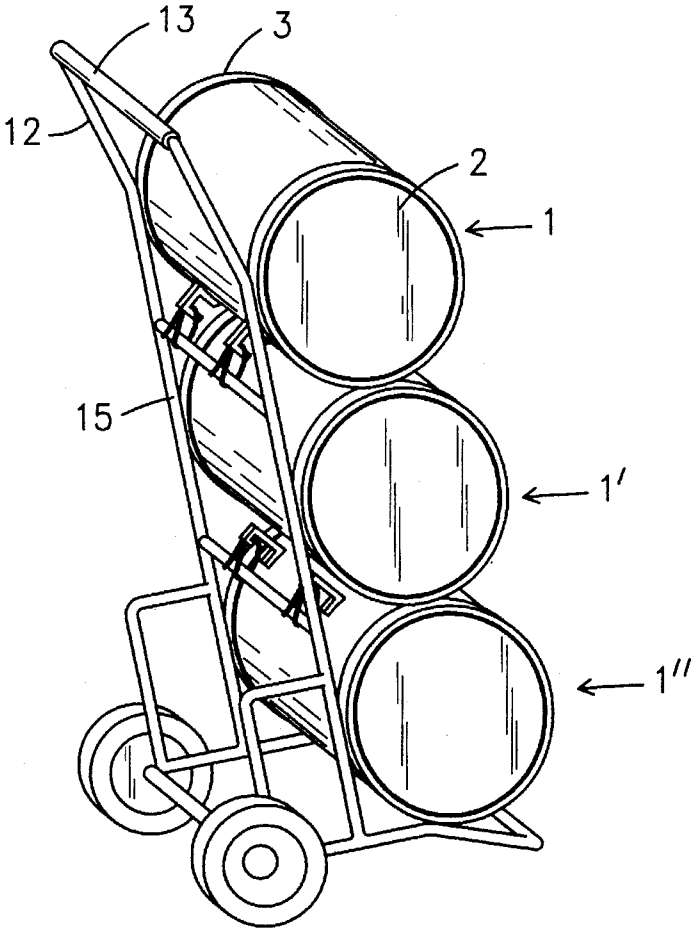
Figure 4:
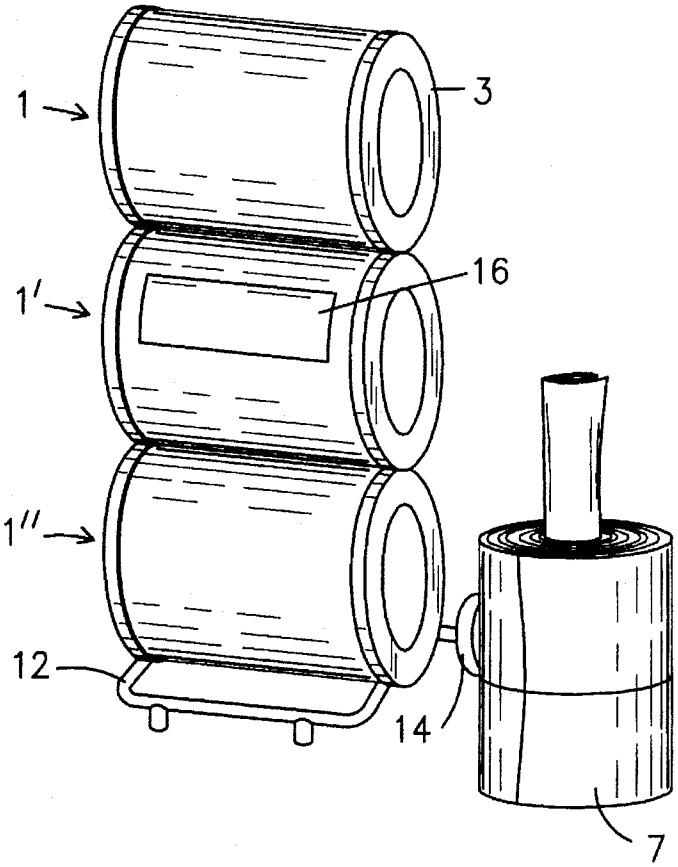

FIG. 1 the newspaper carrying pouch according invention in top view on a tubular shaped container, FIG. 2 a side view of the inventive newspaper carrying pouch viewing the first lid part of the tubular shaped container, FIG. 3 a side view on the inventive newspaper carrying pouch with a view on the second lid part, through which the roll pack can be introduced into the tubular shaped container, FIG. 4 a newspaper wagon with three stacked newspaper carrying pouches according to the invention in front view and a corresponding roll pack, and FIG. 5 a newspaper wagon according to FIG. 4 in side view.

In the following figures, unless indicated otherwise, the Sam reference numerals refer to the same parts and have the same meaning.

FIG. 1 is an illustrative embodiment of an inventive newspaper carrying pouch to be filled with a roll pack 7, as it is also shown in FIG. 4. The newspaper carrying pouch 1 is comprised of a preferably one piece, unitary, can-shaped element, which has a tubular shaped housing wall section. The tubular shaped housing wall is closed off on its first end with a first lid part 2. The first lid part 2 and the tubular shaped housing wall is comprised for example of plastic. The opposite end of the tubular shaped container housing is closed off with a second lid part 3 which is comprised of, for example, a flexible synthetic or natural material, in particular a nylon webbing. Through this second lid part 3 which can be closed by means of a pull string or drawstring or a rubberband or the like, the roll pack 7 is introduced into the inner of the tubular shaped container housing. The tubular shaped container housing is coaxial to a central axis designated X.

The newspaper carrying pouch 1 shown in FIG. 1 in the form of a tubular shaped container has a length L of approximately 41 centimeters and an inner cross-section d of approximately 29 centimeters. It is however understood that a variety of other measurements and dimensions can be utilized, as may be required for the roll pack 7 to be contained.

The tubular shaped container housing is provided on each of its two ends with strengthening elements 10, 11 in the shape of strengthening rings. These strengthening rings serve for the structural stabilization of the tubular shaped container housing and connect thereto with their ring shaped inner walls.

Finally the newspaper carrying pouch 1 as shown in FIG. 1 is provided with two mounting means, attachment means, supports or fixtures 4, 5 on which a carry strap may be secured. These two attachment means 4, 5, which may be, for example, riveted on the tubular shaped housing walls of the newspaper bag 1, are located on the slender outer wall of the tubular shaped container and are axially spaced apart from each other with respect to the central axis X. The attachment means 4, 5 can also serve for the securing of the newspaper carrying pouch 1 on a newspaper wagon.

In FIG. 2 is the newspaper carrying pouch 1 is show in side view with a view on the first lid part 2. In addition to the representation of FIG. 1 a further attachment means 9 is shown, which in relation to the central axis X is positioned superiorly to the attachment means 4, 5 on the outer wall of the tubular shaped container. This attachment means serves in particular thereto to secure the newspaper carrying pouch 1 on another newspaper carrying pouch or on a newspaper wagon. Preferably the attaching means 4, 5, 9 are provided releasably on the newspaper bag 1.

In FIG. 3 the newspaper carrying pouch is likewise shown in side view, but this time however in view on the second lid part 3. This second lid part 3 is comprised according to the invention of at least a partially lockable arrangement, so that the roll pack 7 to be transported in this tubular shaped container can be introduced into this side of the tubular shaped container.

It has also been found to be advantageous to construct this second lid part 3 of a flexible plastic or natural material or the like, for example, of a nylon mesh. This flexible part can be opened and closed by means of an elastic cord 17 which at its end is provided with a snarl 18. It is however to be noted that other locking mechanisms can also be suitably used with the second lid part 3. Thus, there can for example also be used a flap like lid part which can for example be secured to the tubular shaped container housing with a hinge joint or the like.

In FIGS. 4 and 5 there shown respectively a newspaper wagon 12 in the form of a hand wagon with a chassis 15 and wheels 14, on which three newspaper carrying pouch 1 are stacked one above the other according to the invention. The three newspaper carrying pouches 1 are oriented one above the other and are secured above via their mounting means 4, 5, 9 to each other and to the chassis 15 of the hand wagon. For example, leather straps can be employed for this, which are securely attached on the chassis 15 of the hand wagon on the one hand and on the previously mentioned attachment means 4, 5, 9 on the other hand. The three newspaper carrying pouches 1 positioned one above the other are indicated with the reference numerals 1, 1' and 1". As can be seen from FIG. 5, the newspaper wagon 12 is provided with a grip 13 on the upper side of its chassis. As can further be seen from FIG. 4, the newspaper carrying pouch according to the invention can, on its tubular shaped outer wall, be provided with a printed advertising 16.

REFERENCE NUMERAL LEGEND

1 newspaper carrying pouch
2 first lid part
3 second lid part
4 attachment means
5 attachment means
6 opening
7 roll pack
8 bulge
9 attachment means
10 strengthening ring
11 strengthening ring
12 newspaper wagon
13 grip
14 roll
15 chassis or frame
16 printed advertising
17 elastic cord
18 snarl
1' newspaper bag
1" newspaper bag
X middle axis or central axis
d inner diameter
L length

I claim:

1. Newspaper carrying pouch (1) constructed as a tubular shaped flexible container dimensioned to receive a roll pack (7), the tubular shaped flexible container comprising:

a cylindrical body having first and second ends, at least first and second mounting ears for carrying the pouch (4, 5) located on the outer wall of the tubular shaped container and axially spaced apart from each other with respect to the central axis of the tubular shaped container, a first lid part (2) closing off said tubular container at its first end, a second lid part (3) comprised of a natural or synthetic flexible material provided on the container second end, and at least partially closeable by a draw string between a closed position for protecting contents of said container and an open position through which a roll pack (7) can be introduced into the container (1), and first and second ring shaped strengthening members following the circumference of said cylindrical body and provided at the cylindrical body rim where the first and second lid parts respectively meet the cylindrical body.

2. Newspaper carrying pouch according to claim 1, wherein the tubular shaped container is made of plastic.

3. Newspaper carrying pouch according to claims 1, wherein the first lid part (2) is comprised of a plastic.

4. Newspaper carrying pouch according to claim 1, wherein the first lid part (2) and the tubular shaped container are formed as a single piece.

5. Newspaper carrying pouch according to claim 1, wherein the tubular shaped container is provided with strengthening rings (10, 11).

6. Newspaper carrying pouch according to claim 1, wherein said tubular shaped container has an inner diameter of approximately 29 centimeters and wherein the tubular shaped container has a length (L) of approximately 41 centimeters.

7. Newspaper carrying pouch according to claim 1, wherein said mounting ears (4, 5; 9) are riveted to said container.

8. Newspaper carrying pouch according to claim 1, wherein said draw string is an elastic cord.

* * * * *